United States Patent [19]

Goloff et al.

[11] 4,047,855

[45] Sept. 13, 1977

[54] ROTARY MECHANISM WITH IMPROVED COOLING

[75] Inventors: Alexander Goloff, East Peoria; Noble G. Barker, Pekin; Paul J. Staebler, Dunlap, all of Ill.

[73] Assignee: Caterpillar Tractor Co., Peoria, Ill.

[21] Appl. No.: 640,084

[22] Filed: Dec. 12, 1975

[51] Int. Cl.[2] ..... F04C 29/04

[52] U.S. Cl. ..... 418/53; 418/83; 418/178

[58] Field of Search ..... 418/49, 50, 51, 52, 418/53, 83, 178; 123/8.01, 41.8, 41.79; 92/144

[56] References Cited

U.S. PATENT DOCUMENTS

| | | | |
|---|---|---|---|
| 1,279,008 | 9/1918 | Ross | 123/41.8 |
| 2,381,007 | 8/1945 | Seyerle | 123/41.79 |
| 3,102,516 | 9/1963 | Gist et al. | 418/83 X |
| 3,102,517 | 9/1963 | Day et al. | 418/53 X |
| 3,196,851 | 7/1965 | Jungbluth | 418/83 X |
| 3,239,135 | 3/1966 | Fritz | 418/83 |
| 3,280,802 | 10/1966 | Froede | 123/8.01 |
| 3,485,218 | 12/1969 | Clarke | 418/53 |
| 3,989,421 | 11/1976 | Richie | 418/53 |

FOREIGN PATENT DOCUMENTS

| | | | |
|---|---|---|---|
| 995,888 | 6/1965 | United Kingdom | 418/83 |

OTHER PUBLICATIONS

A new class of rotary piston machine suitable for compressors, pumps and internal combustion engines, S. M. Clarke, Proc. Inst. Mech. Eng., 1972, vol. 186, 62/72, pp. 743–753.

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

An improved slant axis rotary mechanism of the type including a housing defining a chamber having a radially outer spherical wall and a radially inner spherical wall interconnected by opposed, generally radially extending side walls. A shaft is journalled within the housing and has an angularly offset portion within the chamber. A rotor is within the chamber and journalled on the angularly offset portion. The mechanism is provided with an improved cooling system including a plurality of coolant receiving conduits in the walls in close proximity to the chamber. A thin, wear resistant layer is disposed on the walls within the chamber and interiorly of the conduits. The conduits are located closely adjacent the intersections of the side walls and the spherical walls to provide excellent cooling.

1 Claim, 4 Drawing Figures

ROTARY MECHANISM WITH IMPROVED COOLING

BACKGROUND OF THE INVENTION

This invention relates to slant axis rotary mechanisms, used as pumps, engines, compressors or the like. More specifically, the invention relates to improved cooling systems in such mechanisms.

One difficulty encountered with slant axis rotary mechanisms employed as engines, compressors, pumps or the like, is short life due to inadequacy in cooling. As is typical with most rotary engines known today, machining marks on the internal surfaces of the housing generally tend to be oriented in the wrong direction, i.e., generally parallel to the direction of seal travel, with the result that seal failure will occur in very short intervals where oil viscosity is insufficient to develop an oil film of adequate thickness. Of course, increased lubricant viscosity sufficient to maintain an adequate oil film is encouraged with adequate cooling.

SUMMARY OF THE INVENTION

It is the principal object of the invention to provide a new and improved slant axis rotary mechanism. More specifically, it is an object of the invention to provide such a mechanism having improved cooling whereby lubricant viscosity may be maintained at a relatively high level.

An exemplary embodiment of a slant axis rotary mechanism made according to the invention includes a housing defining a chamber having a radially outer spherical wall and a radially inner spherical wall. The spherical walls were interconnected by opposed, generally radially extending side walls and a shaft is journalled within the housing and has an angularly offset portion within the chamber. A rotor is disposed within the chamber and is journalled on the angularly offset portion. The improved cooling system includes a plurality of coolant receiving grooves in the walls and a thin cover plate for the walls and thus the grooves. The cover plate is supported against collapse by the wall portions between the grooves.

In a highly preferred embodiment of the invention, at least certain of the grooves are disposed closely adjacent the intersections of the side walls and the spherical walls, a disposition made possible through the use of the thin cover plate.

In one embodiment, the grooves may be circumferentially disposed, while according to another embodiment, the grooves may be radially disposed.

In a highly preferred embodiment, the side walls are formed by side wall members separate from the outer spherical wall and gas seals are disposed at the interface of the side wall members and the outer spherical wall. At least one of the coolant receiving grooves is disposed between the gas seal and the chamber along the interface whereby adequate cooling of the gas seal is achieved, promoting long life thereof.

Other objects and advantages will become apparent from the following specification taken in connection with the accompanying drawings.

DESCRIPTION OF THE PREFERRED EMBODIMENTS

Figure 1:
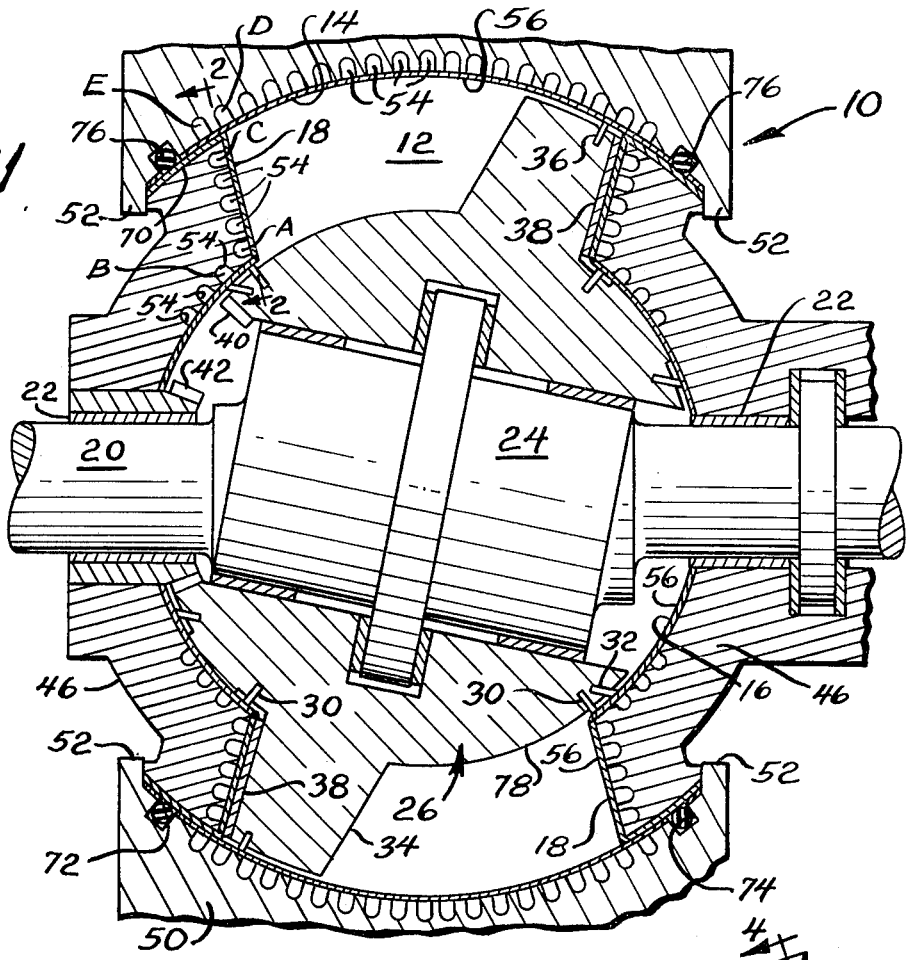
FIG. 1 is a sectional view of a slant axis rotary mechanism in the form of a four-cycle engine made according to the invention.

An exemplary embodiment of a slant axis rotary mechanism made according to the invention is illustrated in FIG. 1 in the form of a four-cycle engine. However, it is to be understood that the principles of the invention are applicable to such mechanisms employed in uses other than as engines as, for example, as pumps, compressors, or the like. Similarly, the invention is applicable to such mechanisms operating on other then four-cycle principles as, for example, two-cycle mechanisms.

The mechanism includes a housing, generally designated 10, having an interior chamber 12. The chamber 12 is bounded by a radially inner spherical wall 14, a radically inner spherical wall 16, and opposed, generally radially extending side walls 18 which interconnect the spherical walls 14 and 16.

A shaft 20 is journalled as by bearings 22 in the housing and includes an angularly offset portion 24 within the chamber 12. A rotor, generally designated 26, is journalled on the angularly offset portion 24 within the chamber 12. The rotor 26 has a spherical hub 28 carrying compression seals 30 which engage the radially inner spherical wall 16 and oil seals 32 which also engage the radially inner spherical wall 16.

The rotor 26 is completed by a peripheral flange 34 which carries peripheral seals 36 on its radially outer surface and which sealingly engage the radially outer spherical wall 14. As is well known, the flange 34 has a plurality of apices, in a four-cycle mechanism, three on each side, and at each such apex, there is disposed an apex seal 38. The apex seals 38 sealingly engage a respective one of the side walls 18.

One end of the hub 28 carries an internal ring gear 40 which is meshed with a timing gear 42 carried by the housing 10 to achieve the proper timed relative rates of rotation between shaft 20 and the rotor 26.

Figure 2:
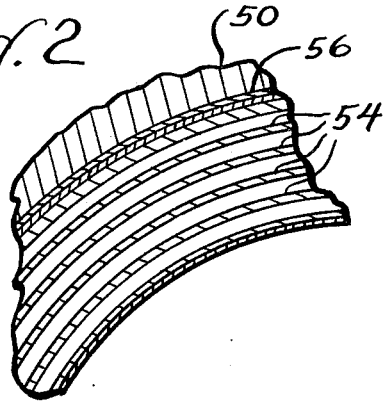
FIG. 2 is a fragmentary sectional view taken approximately along the line 2—2 of FIG. 1.

The housing 10 is defined by opposed side wall members 46 which carry both the side walls 18 and the radially inner spherical wall 16. The housing 10 is completed by an outer wall member 50 which carries the radially outer spherical wall 14. As can be seen, the side wall members 46 are maintained in place by abutment with inwardly directed flanges 52 on the outer wall member 50. Cooling is achieved by the provision of a plurality of coolant receiving grooves 54 in each of the walls 14, 16 and 18. In the embodiment illustrated in FIGS. 1 and 2, the grooves 54 extend circumferentially. A thin cover plate 56 formed of a wear resistant material as, for example, chromium plated steel, defines the various ones of the walls in terms of being the surface against which the various seals rub. At the same time, the thin cover plate 56 closes each of the grooves 54 to form conduits for the coolant. As can be seen from FIG. 1, conduits A and B are closely adjacent at the intersection of the radially inner spherical wall 16 and respective ones of the side walls 18 to provide excellent cooling thereat to promote a thick oil film to thereby provide excellent lubrication. Similarly, conduits C and D are closely adjacent the interface of respective ones of the side walls 18 and the radially outer spherical wall for the same purpose. It will be appreciated that through the use of the thin cover plate 56, which normally, will be on the order of about one-tenth inch thick, that coolant may be directed very close to such intersections.

Separate ones of the plates 56 may be used for each of the walls involved. Alternately, on each of the end walls, a single plate may be formed to define the radially inner spherical wall 16 and the corresponding side wall 18. In such a case, a part 70 thereof may be folded over towards the flange 52. Adjacent its ends, the plate 56 defining the radially outer spherical wall may be apertured as at 72 and a groove 74 disposed in each side of the outer wall member 50. A gas seal 76 may be disposed at the interface of the elements. In such a case, it is desirable that one of the grooves E be located between the chamber 12 and the gas seal 76 so that gases heated either by compression or combustion or both, and passing along the interface, are cooled before contacting the gas seal 76. Thus, the gas seal 76 may be formed of an elastomer without particular concern for its thermal properties, since it will be adequately cooled by the presence of coolant in the groove E.

It will be observed that in the case of each of the walls, the thin cover plate 56 is supported by those portions of the corresponding wall member disposed between the grooves 54. Any suitable porting extending through the wall members 46 or 50 can be employed for the purpose of directing a coolant to the grooves 54.

Figure 3:
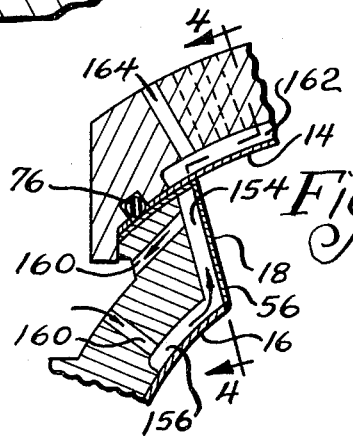
FIG. 3 is a fragmentary sectional view of a modified embodiment of the invention.
Figure 4:
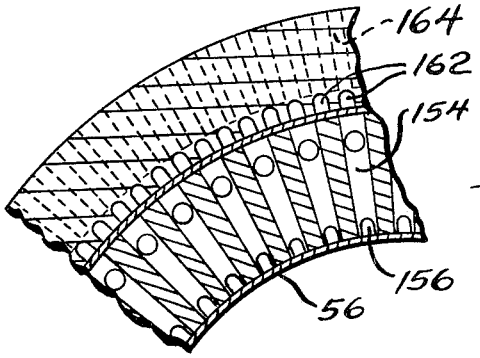
FIG. 4 is a sectional view taken approximately along the line 4—4 of FIG. 3.

FIGS. 3 and 4 illustrate a modified embodiment of the invention wherein the coolant receiving grooves are generally radially directed. For example, grooves 154 are disposed in the side walls 18 and extend radially. A continuation 156 of each of the grooves 154 extends into adjacency with the cover plate at the radially inner spherical wall 16. Ports 160 allow the introduction and exist of coolant as illustrated by arrows in FIG. 3.

Separate and distinct conduits are defined by grooves 162 extending across the radially outer spherical wall 14 and coolant may be introduced through a conduit 164 and removed from a similar conduit (not shown) adjacent the opposite side wall 18. Again, the portions of the wall members between the various grooves support the cover plate against collapse.

What is claimed is:

1. In a slant axis rotary mechanism including a housing defining a chamber having a radially outer spherical wall and a radially inner spherical wall interconnected by opposed, generally radially extending side walls, a shaft journalled within said housing and having an angularly offset portion within said chamber, and a rotor within said chamber and journalled on said angularly offset portion, an improved cooling system including a plurality of coolant receiving grooves in said walls, and a thin cover plate for said walls and thus said grooves and being supported against collapse by the wall portions between said grooves; said side walls being formed by side wall members separate from said outer spherical wall, gas seal means sealing the interfaces of said side wall members and said outer spherical wall, there being at least one said groove between said gas seal means and said chamber along said interface.

* * * * *